US007694382B2

(12) United States Patent
Williams et al.

(10) Patent No.: US 7,694,382 B2
(45) Date of Patent: Apr. 13, 2010

(54) FLOOR CLEANING TOOL

(75) Inventors: Steve Williams, Hayden Lake, ID (US); Michael Genteman, Liberty Lake, WA (US); David Wood, Maple Plain, MN (US)

(73) Assignee: USP Holding Corp., Coeur d'Alene, ID (US)

( * ) Notice: Subject to any disclaimer, the term of this patent is extended or adjusted under 35 U.S.C. 154(b) by 268 days.

(21) Appl. No.: 11/789,743

(22) Filed: Apr. 24, 2007

(65) Prior Publication Data

US 2008/0263812 A1 Oct. 30, 2008

(51) Int. Cl.
*A47L 7/00* (2006.01)

(52) U.S. Cl. ..... 15/322; 15/321; 15/415.1

(58) Field of Classification Search ..... 15/320–322, 15/414, 415.1, 401, 402, 420–422.1
See application file for complete search history.

(56) References Cited

U.S. PATENT DOCUMENTS

| | | | | | |
|---|---|---|---|---|---|
| 855,433 | A | | 5/1907 | Freeman | |
| 930,134 | A | | 8/1909 | Blackall | |
| 933,003 | A | | 8/1909 | Smith | |
| 1,192,409 | A | | 7/1916 | Frame | |
| 2,219,802 | A | | 10/1940 | Bjorkman | |
| 2,822,061 | A | | 2/1958 | Pettit et al. | |
| 3,072,951 | A | | 1/1963 | Kelnhofer | |
| 3,210,792 | A | * | 10/1965 | Sassano, Sr. | 15/401 |
| 3,520,012 | A | * | 7/1970 | Carabet et al. | 15/402 |
| 3,571,841 | A | * | 3/1971 | Crouser | 15/401 |
| D223,173 | S | | 3/1972 | Howard et al. | |
| 3,708,824 | A | | 1/1973 | Holubinka | |
| 3,771,193 | A | | 11/1973 | Hageal | |
| 3,919,729 | A | | 11/1975 | Cannan | |
| 4,074,387 | A | | 2/1978 | Arato et al. | |
| 4,161,802 | A | | 7/1979 | Knight et al. | |
| 4,275,478 | A | | 6/1981 | Kohlenberger | |
| D264,139 | S | | 4/1982 | Pearman, Jr. | |
| 4,333,203 | A | * | 6/1982 | Yonkers | 15/321 |
| 4,334,336 | A | | 6/1982 | Harbeck et al. | |
| 4,677,705 | A | | 7/1987 | Schuster | |
| 5,280,666 | A | | 1/1994 | Wood et al. | |
| 5,419,007 | A | * | 5/1995 | Hult et al. | 15/401 |
| 5,634,238 | A | | 6/1997 | McCaffrey et al. | |
| 5,655,255 | A | | 8/1997 | Kelly | |
| 5,659,923 | A | | 8/1997 | Coombs | |
| 5,891,198 | A | * | 4/1999 | Pearlstein | 8/158 |
| 6,266,892 | B1 | | 7/2001 | Haynie | |
| 6,298,577 | B1 | | 10/2001 | Haynie | |
| 6,421,875 | B1 | | 7/2002 | Coombs et al. | |
| 6,453,506 | B1 | * | 9/2002 | Sumner | 15/322 |
| 6,513,192 | B1 | | 2/2003 | Pearlstein | |
| 6,981,338 | B2 | | 1/2006 | Jensen et al. | |
| 2008/0196198 | A1 | * | 8/2008 | Labarbera et al. | 15/415.1 |

* cited by examiner

*Primary Examiner*—Dung Van Nguyen
(74) *Attorney, Agent, or Firm*—Wells St. John PS

(57) ABSTRACT

A floor cleaning tool is described and which includes a vacuum chamber having a fluid intake end, and a fluid exhaust end; a coupling member defining a fluid passageway extending therethrough, and which is integrally coupled to the fluid intake end of the vacuum chamber; and a floor engagement member having a plurality of inlet ports, and which is releasably secured to the coupling member by means of a mortise and tenon joint.

24 Claims, 10 Drawing Sheets

FLOOR CLEANING TOOL

TECHNICAL FIELD

The present invention relates to a floor cleaning tool, and more specifically to a floor cleaning tool which finds usefulness when coupled with a wet vacuum system, and in particular which provides enhanced cleaning capabilities not possible heretofore in floor cleaning tools of this type.

BACKGROUND OF THE INVENTION

The beneficial effects of employing various floor cleaning tools in combination with wet vacuum systems of assorted styles and designs are well known. The prior art is replete with numerous examples of vacuum cleaner floor tools of various designs and which are useful for removing liquid and debris from assorted flooring surfaces. The Office's attention is specifically directed to U.S. Pat. Nos. 5,655,255; 5,659,923; 6,266,892; 6,298,577; 6,421,875 and 6,981,338. The teachings of the prior art U.S. Patents are incorporated by reference herein. While these various prior art vacuum cleaner floor tools have operated with varying degrees of success, various shortcomings attendant with the prior art designs have detracted from their usefulness. For example, and referring more specifically to U.S. Pat. No. 5,659,923 to Coombs, this invention relates to a floor cleaning tool which does not utilize a rotating beater bar brush, but instead simply applies vacuum and mild agitation to the carpet pile to clean the carpet. It is evident from a study of the drawings of that patent, and more specifically to FIG. 4, that the design as proposed in the Coombs reference does not provide a means by which the vacuum of the floor cleaning tool can be maximized in view of the orientation of the air passageway coupling the floor cleaning tool with a vacuum conduit. In this regard, and as seen in FIG. 4, the very sharp angles provided in the tool, and more specifically the vacuum chamber housing decreases the cleaning efficiency of same. Moreover, the design as provided for in U.S. Pat. No. 5,659,923 is generally considered difficult to service. For example, it is quite difficult to remove and service the glides 18 and 22, respectively, and which ride in contact with the surface which is being cleaned.

Additionally, many of the prior art references employ a tapered shape which is effective to penetrate, at least in part, to some degree, a carpet surface upon which it is employed. This type of a design is quite unsatisfactory inasmuch as friction is increased, thereby causing undue wear on the carpet, and increasing the amount of physical labor required to move such a device across a flooring surface.

A floor cleaning tool which avoids the shortcomings attendant with the prior art practices and methodology utilized heretofore is the subject matter of the present application.

SUMMARY OF THE INVENTION

A first aspect of the present invention relates to a floor cleaning tool, and which includes a vacuum chamber having a fluid intake end, and a fluid exhaust end; a coupling member defining a fluid passageway extending therethrough, and which is integrally coupled to the fluid intake end of the vacuum chamber; and a floor engagement member having a plurality of inlet ports, and which is releasably secured to the coupling member by means of a mortise and tenon joint.

Another aspect of the present invention relates to a floor cleaning tool, and which includes a vacuum chamber having a fluid intake end, and a fluid exhaust end, and which is rotationally molded from a thermoplastic material as a single piece; a coupling member defining a fluid passageway extending therethrough, and which is integrally coupled to the fluid intake end of the vacuum chamber; and a floor engagement member having a plurality of inlet ports, and which matingly cooperates with the fluid intake end of the vacuum chamber.

Still further, another aspect of the present invention relates to a floor cleaning tool for use with a vacuum cleaner, and which includes a vacuum conduit having an inside cross sectional dimension, and wherein the vacuum conduit is coupled in fluid flowing relation relative to a vacuum cleaner; a vacuum chamber having a fluid intake end, and a fluid exhaust end which is made integral with the vacuum conduit; a coupling member defining a fluid passageway therethrough, and which is integrally affixed to the fluid intake end of the vacuum chamber; and a floor engagement member which releasably slideably cooperates with the coupling member, and which defines a plurality of inlet ports each having a cross sectional area dimension, and wherein the sum total of the cross sectional dimensions of the plurality of inlet ports is greater than about 70% of the cross sectional dimension of the vacuum conduit.

Yet further, another aspect of the present invention relates to a floor cleaning tool for use with a vacuum cleaner, and which includes a vacuum conduit having a first intake end, and an opposite exhaust end, and wherein the exhaust end is disposed in fluid discharging relation relative to a vacuum cleaner, and wherein the vacuum conduit defines an internal cross sectional area; a vacuum chamber made integral with the vacuum conduit, and wherein the vacuum chamber has a first intake end which defines an elongated aperture, and an opposite exhaust end which is coupled in fluid flowing relation relative to the first intake end of the vacuum conduit, and wherein the vacuum chamber has a width dimension which diminishes when measured in the direction extending from the first intake end of the vacuum chamber in the direction of the second exhaust end thereof; a coupling member having a main body which defines a passageway, and which extends therethrough, and which is further defined by first and second portions, and wherein the first portion of the coupling member is coupled in fluid flowing relation relative to the first intake end of the vacuum chamber, and wherein the second portion is made integral with the first intake end of the vacuum chamber, and wherein the first portion further defines at least one tenon which extends laterally outwardly relative thereto; and a floor engagement member which defines a mortise for matingly receiving the at least one tenon of the first portion of the coupling member, and wherein the floor engagement member further defines a plurality of substantially equally spaced inlet ports which each have a substantially equal diametral dimension and cross sectional area, and which further extend through the floor engagement member and are disposed in fluid flowing relation relative to the passageway which is defined by the coupling member, and wherein the floor engagement member has a complexly curved bottom surface which moves across a floor to be cleaned, and wherein each of the plurality of inlet ports is defined by a longitudinal axis, and wherein the floor engagement member locates the floor cleaning tool in an ergonomically acceptable orientation for an operator thereof when the respective longitudinal axes of the respective inlet ports are oriented substantially perpendicular relative to a floor, and wherein the sum totals of the cross sectional areas of the individual inlet ports lies in a range of about 70% to less than 85% of the cross sectional area of the vacuum conduit.

In addition to the foregoing, the present invention relates to a floor cleaning tool for use in a wet vacuum system, and which includes a fluid receiving conduit with a substantially circular cross sectional shape, and which is defined by an inner diameter dimension; a vacuum chamber having a fluid intake end with a substantially elongated cross sectional shape; a fluid exhaust end with a substantially circular cross sectional shape; and an intermediate cross sectional shape that transitions smoothly from the fluid intake end to the fluid exhaust end; and wherein the fluid exhaust end is coupled in fluid flowing relation relative to the fluid receiving conduit; a coupling member defining a fluid passageway therethrough, and which is disposed in fluid flowing relation relative to the fluid intake end of the vacuum chamber; and wherein the coupling member has a first portion which is spaced from the vacuum chamber, and which releasably matingly couples with a floor engagement member; and wherein the coupling member has a second portion which is made integral, at least in part, with the fluid intake end of the vacuum chamber, and which includes a plurality of anchoring members that are made integral with the second portion, and which further extend in the direction of the vacuum chamber; and wherein the vacuum chamber is rotationally molded from a thermoplastic material as a single piece, and the plurality of anchoring members are embedded within the molded thermoplastic material in a manner such that the coupling member is integrally coupled to the vacuum chamber.

Still further, a floor cleaning tool of the present invention includes a vacuum chamber having a fluid intake end, and a fluid exhaust end; a coupling member which is integrally coupled to the fluid intake end of the vacuum chamber, and which further has an elongated main body defined by opposite sidewalls, opposite first and second ends, a bottom surface, and a top surface, and which has a fluid passageway defined by the main body, and extends between the top and bottom surfaces, and wherein the fluid passageway further has a first portion which extends from the bottom surface in the direction of the top surface, and a second portion which is coupled in fluid flowing relation relative to the first portion, and which extends from the first portion to the top surface of the main body, and wherein the second portion has a cross sectional dimension greater than the cross sectional dimension of the first portion; and wherein the coupling member further has a plurality of anchors made integral with the top surface thereof, and which extend normally upward relative to the top surface, and which each define a cavity which extends therethrough, and which are recessed laterally inwardly relative to the opposite sidewalls thereof; and wherein the main body of the coupling member further has a pair of tenons which individually extend normally outwardly, and in a coplanar relation relative to the bottom surface of the main body; and a floor engagement member having a plurality of inlet ports, and which is releasably secured to the coupling member by means of a mortise and tenon joint, and which has a main body having a top surface, and a bottom surface, which is defined, in part, by a leading edge and a trailing edge; and wherein the inlet ports are defined by the main body and are substantially equally spaced along the length of the main body, and extend between the top and bottom surfaces thereof, and wherein the floor engagement member further has a pair of sidewalls made integral with the top surface of the main body, and further extending normally upwardly relative thereto, and wherein the pair of sidewalls are substantially coplanar with the leading and trailing edges of the main body and define therebetween a mortise which is dimensioned to matingly receive the pair of tenons; and wherein the leading edge of the main body of the floor engagement member is complexly curved, and wherein the plurality of inlet ports are located in a non-perpendicular orientation relative to the top surface of the main body, and wherein the inlet ports terminate at the top surface of the main body and are located about equidistantly from each of the sidewalls which defines the mortise, and wherein the plurality of inlet ports are substantially equally spaced along the main body from the first to the second ends thereof; and wherein the vacuum chamber is defined by a sidewall having opposite interior and exterior facing surfaces, and wherein the fluid intake end of the vacuum chamber is matingly received, at least in part, within the second portion of the fluid passageway as defined by the coupling member, and wherein the plurality of anchors are made integral with the sidewall of the vacuum chamber and in the region which is adjacent to the fluid intake end thereof, and wherein the respective anchors are located between the interior and exterior facing surfaces thereof, and wherein the exterior facing surface of the sidewall of the vacuum chamber is substantially coplanar with the opposite sidewalls of the coupling member.

Yet another aspect of the present invention relates to a floor cleaning tool which comprises a vacuum conduit having a first intake end, and an opposite exhaust end, and wherein the exhaust end is disposed in fluid discharging relation relative to a vacuum cleaner, and wherein the vacuum conduit defines an internal cross sectional area; a vacuum chamber made integral with the vacuum conduit, and wherein the vacuum chamber has a first intake end which defines an elongated aperture, and an opposite exhaust end which is coupled in fluid flowing relation relative to the first intake end of the vacuum conduit, and wherein the vacuum chamber has a width dimension which diminishes when measured in the direction extending from the first intake end of the vacuum chamber in the direction of the second exhaust end thereof; and a floor engagement member which is operably oriented relative to the first intake end of the vacuum chamber and which defines a plurality of substantially equally spaced inlet ports which each have a substantially equal diametral dimension and cross sectional area, and which further extend through the floor engagement member and are disposed in fluid flowing relation relative to the vacuum chamber, and wherein the sum totals of the cross sectional areas of the individual inlet ports lies in a range of greater than about 70% of the cross sectional area of the vacuum conduit, and wherein the floor engagement member does not substantially penetrate a carpeted flooring surface upon which it is being employed.

These and other aspects of the present invention will be described in greater detail hereinafter.

BRIEF DESCRIPTION OF THE DRAWINGS

Preferred embodiments of the invention are described below with reference to the following accompanying drawings.

FIG. 6 is an exploded, fragmentary, bottom plan view of a floor cleaning tool of the present invention.

FIG. 13 is a greatly simplified environmental view showing the present invention in operation.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
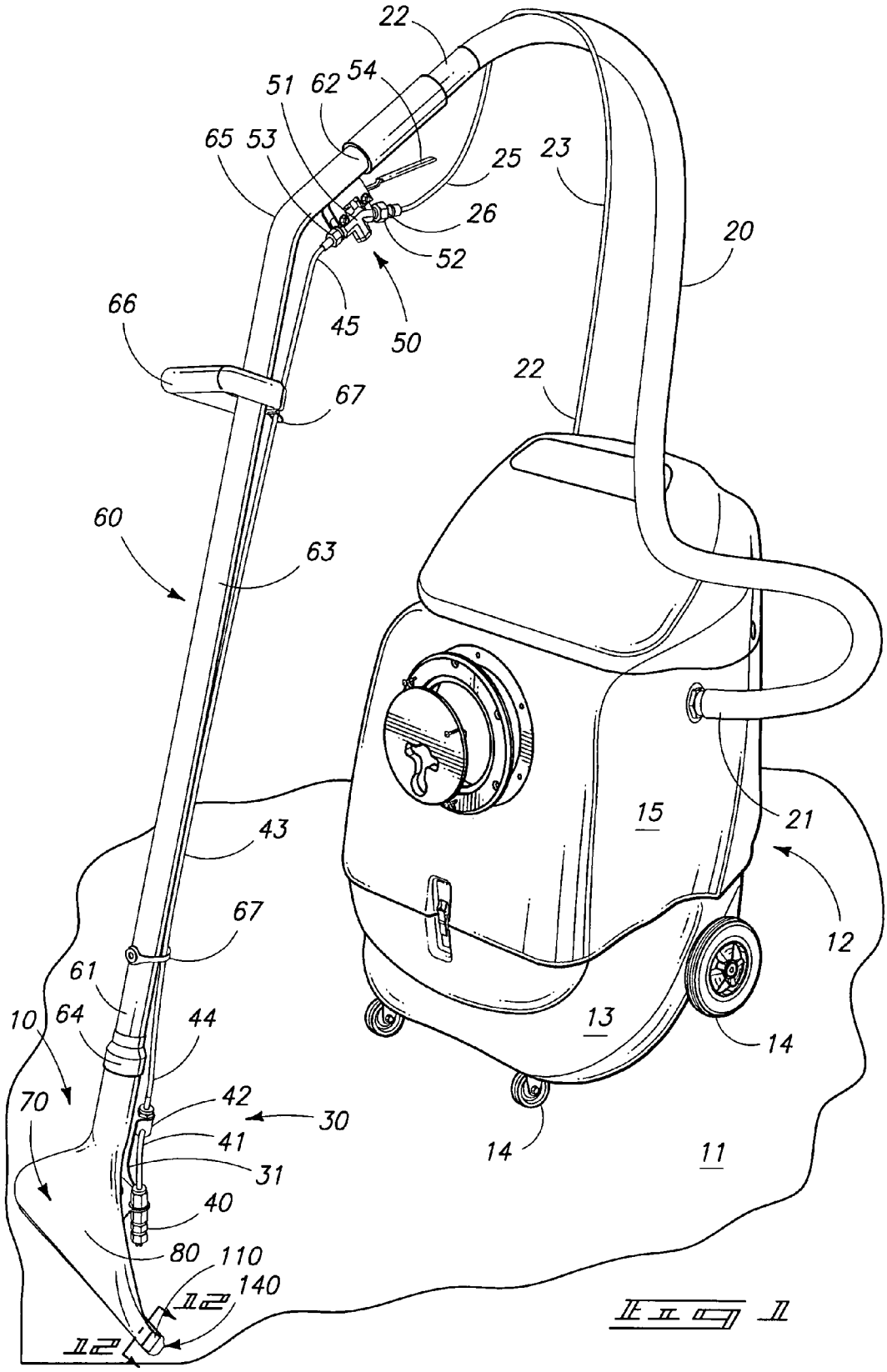
FIG. 1 is a perspective, environmental view of a floor cleaning device of the present invention, and which is employed with a conventional wet vacuum system.

A floor cleaning tool of the present invention is generally indicated by the numeral 10 in FIG. 1, and following. Referring now to FIG. 1, it will be seen that the floor cleaning tool 10 which is often referred to as a fluid extraction wand is useful in cleaning various flooring surfaces, here generally indicated by the numeral 11. The surface may comprise a hard surface or more typically a carpeted surface which requires cleaning. The floor cleaning tool 10 is utilized in combination with a wet vacuum system which is generally indicated by the numeral 12 and which is moveable across the surface to be cleaned 11. One form of the vacuum system is described below. However, it will be recognized that this invention could be employed on so-called walk behind, rider/extractor, and/or other mobile frame vacuum systems (not shown). In this regard, the wet vacuum system 12 includes a base member 13 which mounts floor engaging wheels 14, and which roll across the surface to be cleaned 11. Still further, and mounted above the moveable base 13 is a fluid collection tank which is generally indicated by the numeral 15. Coupled in fluid flowing and delivering relation relative to the fluid collection tank 15 is a flexible, fluid receiving hose which is generally indicated by the numeral 20. The fluid receiving hose has a first end 21, which is mounted in fluid flowing relation relative to the fluid collection tank 15, and an opposite distal, second end 22. The flexible hose 20 has a given length dimension which allows an operator (not shown) to work at a distance from the wet vacuum system 12. In addition to the foregoing, the wet vacuum system 12 further includes a flexible fluid dispensing hose which is generally indicated by the numeral 23. The fluid dispensing hose 23 has a first end 24, which is coupled in fluid receiving relation relative to the wet vacuum system 12, and an opposite, second end 25 which is coupled to the floor cleaning tool 10. In this regard, the second end 25 includes a releasable fluid coupler 26 which allows the second end 25 to be disengaged from the floor cleaning tool 10 in a manner which is well known in the art.

Figure 2:
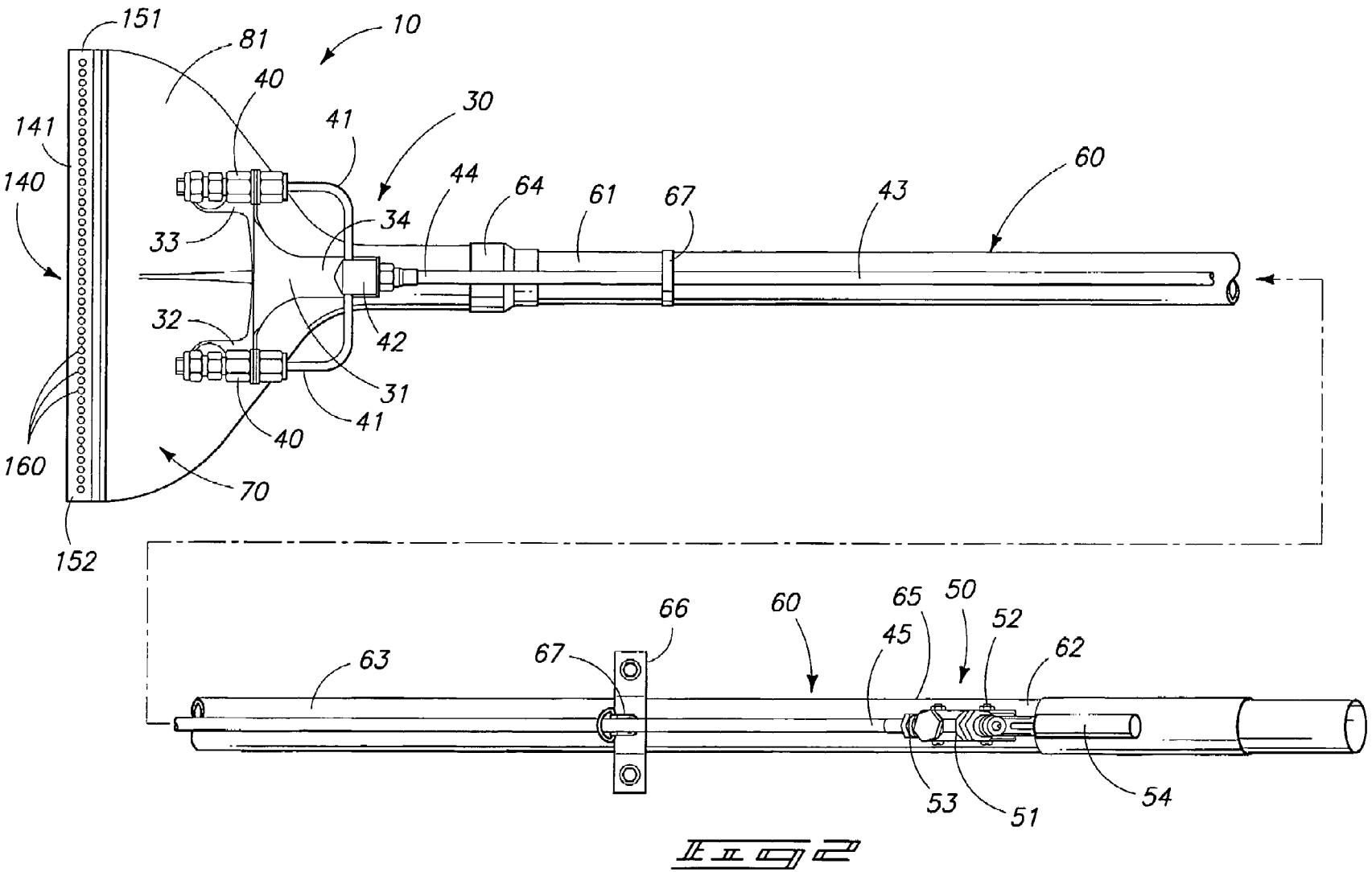
FIG. 2 is a bottom plan view of the floor cleaning tool of the present invention.

A fluid dispenser 30 is releasably mounted on the floor cleaning tool 10 in a manner which will be discussed in greater detail, below. The fluid dispenser which is generally indicated by the numeral 30 is releasably mounted on the floor cleaning tool 10 by a substantially y-shaped or branched support member which is indicated by the numeral 31 (FIG. 2). The support member 31 is defined by first and second arms 32 and 33 which are disposed in substantially parallel, spaced relation, one relative to the other. Still further, the first and second arms are connected to a common base portion 34. A pair of fluid dispensing nozzles 40 are individually mounted on the respective first and second arms 32 and 33, and are positioned in spaced relation relative to the floor cleaning tool 10. The pair of fluid dispensing nozzles 40 are supplied with a source of a cleaning fluid by means of individual fluid delivery conduits 41 which are coupled in fluid flowing relation relative to the respective fluid dispensing nozzles 40. The respective fluid delivery conduits 41 are coupled in fluid flowing relation relative to a fluid conduit coupler 42. The coupler 42 is mounted on the base portion 34 of the Y-shaped support member 31. Still further, the rigid fluid delivery conduit 43 is coupled in fluid flowing relation relative to the fluid conduit coupler 42. The rigid, fluid delivery conduit 43 has a first end 44 which is coupled in fluid flowing relation relative to the coupler 42; and an opposite, second end 45 which is coupled in fluid flowing relation relative to a hand actuatable valve assembly which is generally indicated by the numeral 50. In this regard, the valve assembly 50 has a valve body 51 having a first intake end 52 which is coupled in fluid flowing relation relative to the second end 25 of the flexible fluid dispensing hose 23. Still further, the valve body has a second, exhaust end 53 which is coupled in fluid flowing relation relative to the second end 45 of the rigid fluid delivery conduit 43. A hand engageable lever 54 is moveably mounted on the valve body 51 and provides a convenient means whereby an operator may exert force on the engageable lever 54 in order to initiate the flow of fluid which is dispensed from the wet vacuum system 12. The fluid dispensed by the wet vacuum system 12 travels through the valve body 51 and through the rigid fluid delivery conduit 43 for delivery to the pair of fluid dispensing nozzles 40. The fluid dispensing nozzles 40 are operable to dispense the fluid provided in a given pattern on the adjacent flooring surface 11 to be cleaned in a manner which is well known in the art. A rigid vacuum conduit 60 is provided, and is coupled in fluid flowing relation relative to the second end 22 of the flexible fluid receiving hose 20. The rigid vacuum conduit 60 has a first intake end 61, which is coupled in fluid receiving relation relative to the floor cleaning tool 10, and further has an opposite second exhaust end 62 which is coupled in fluid flowing relation relative to the flexible fluid receiving hose 20. Additionally, the rigid vacuum conduit 60 has an intermediate portion 63 which is disposed between the first and second ends 61 and 62, thereof. An enlarged coupler 64 is mounted on the first intake end 61, and is operable to matingly engage the floor cleaning tool 10 as will be discussed in greater detail hereinafter. Additionally, it will be seen by a study of FIG. 1 that a bend 65 is made in the rigid vacuum conduit at a location which is near the second exhaust end 62. This permits the rigid vacuum conduit 60 to be positioned in an appropriate orientation so it may be used conveniently by an operator 68 (FIG. 13). Moreover, and placed in spaced relation relative to the bend 65 is a handle 66 which may be grasped by the operator 68 so that the operator may direct the rigid vacuum conduit 60 into various orientations relative to the surface 11 to be cleaned. In addition to the foregoing, a plurality of conduit guide members 67 are mounted therealong the rigid vacuum conduit 60 in order to support the rigid fluid delivery conduit 43 in spaced relation relative thereto. This is shown most clearly by reference to FIGS. 1 and 2, respectively.

Figure 7:
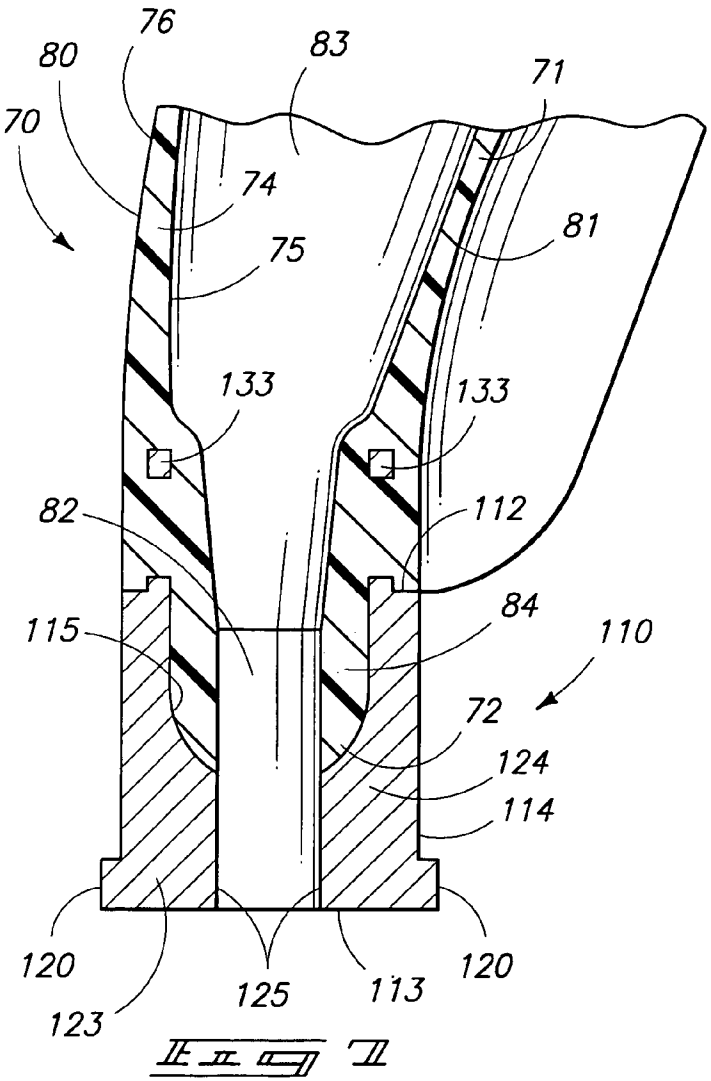
FIG. 7 is a transverse, vertical, sectional view taken from a position along the line 7-7 of FIG. 6.

Referring now to FIGS. 6 and 7, it will be seen that the floor cleaning tool 10 of the present invention includes a vacuum chamber which is generally indicated by the numeral 70. The vacuum chamber is defined by a main body 71, which has a first fluid intake end 72, and an opposite, second fluid exhaust end which is generally indicated by the numeral 73, and which is coupled in fluid flowing relation relative to the first intake end 61 of the rigid vacuum conduit 60. As understood by a study of FIGS. 6 and 7, the vacuum chamber 70 has a width dimension which gradually or smoothly diminishes when measured in the direction extending from the first intake end 72, to the second fluid exhaust end 73. The shape of the vacuum chamber provides a substantial laminar flow of air, and water, which is passing therethrough as it enters the first fluid intake end. While not being bound to any inventive theory, it is believed that this shape substantially reduces any air turbulence within the vacuum chamber. The overall effect appears to make this particular invention quite effective in cleaning a floor 11 while employing a vacuum motor (not shown) having reduced power requirements. The main body 71 is defined by a sidewall 74 which has an inside facing surface 75 and an opposite outside facing surface 76 (FIG. 7). Still further, the main body has a top or upwardly facing surface 80 and an opposite, bottom, or downwardly facing surface 81 when the floor cleaning tool 10 is being commonly utilized. Additionally, it will be recognized that an elongated aperture 82 (FIG. 7) is formed in the first fluid intake ends 72. Still further, the inside facing surface 75 of the sidewall 74 defines a vacuum chamber cavity 83. Still further, as seen by reference to FIG. 7, the first fluid intake end 72 includes a male member 84 which is received internally of a coupling member which will be discussed in greater detail hereinafter. As should be understood, the main body 71 of the vacuum chamber 70 is rotatably molded from a thermoplastic material in order to provide the benefits that will be discussed in greater detail, below.

Figure 10:
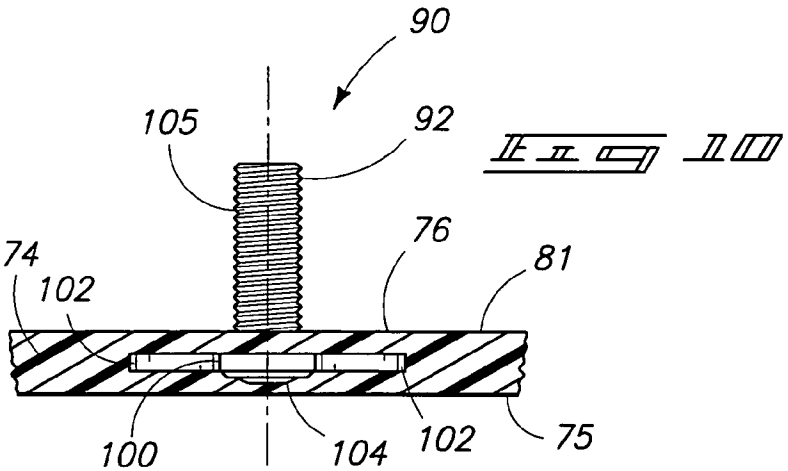
FIG. 10 is a transverse, vertical, sectional view of a second form of a threaded coupler which forms a feature of the present invention, and which is taken from a position along line 10-10 of FIG. 6.
Figure 10A:
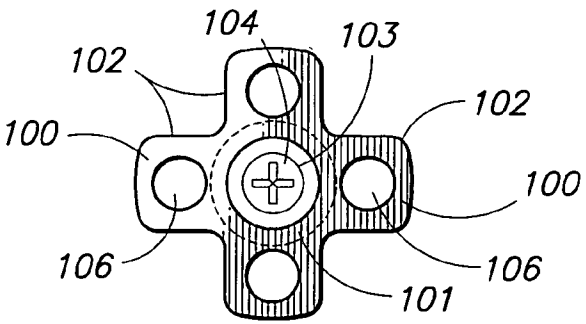
FIG. 10A is a bottom plan view of the threaded coupler as seen in FIG. 10.
Figure 9:
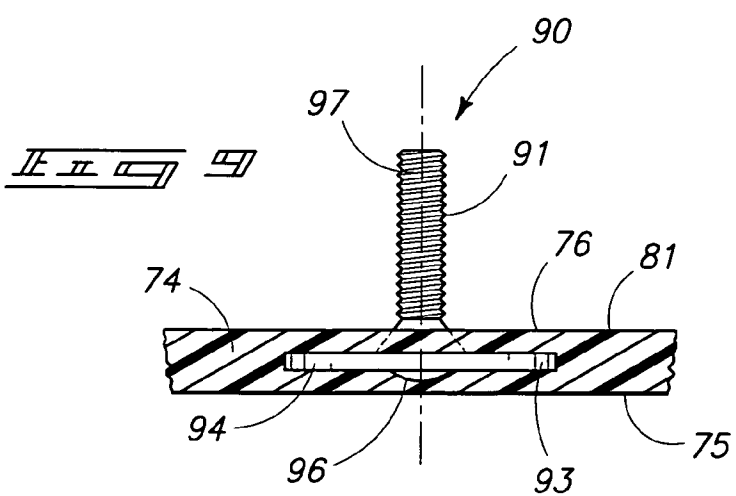
FIG. 9 is a transverse, vertical, sectional view of a first form of a threaded coupler which forms a feature of the present invention and which is taken from a position along line 9-9 of FIG. 6.
Figure 9A:
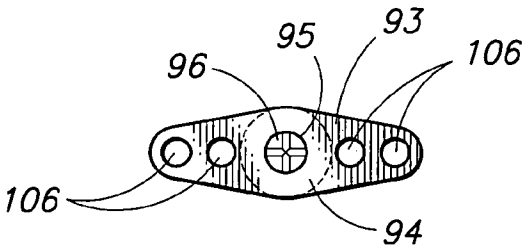
FIG. 9A is a bottom plan view of the threaded coupler as seen in FIG. 9.

Referring now to FIGS. 6, 9, 9A, 10 and 10A, it will be seen that the floor cleaning tool 10, and more specifically the bottom surface 81 thereof, has a plurality of imbedded fasteners 90 extending outwardly therefrom. The imbedded fasteners 90 are operable to threadably engage the Y-shaped support member 31, and more specifically the first and second arms 32 and 33 thereof, thereby fixedly positioning the pair of fluid dispensing nozzles 40 in predetermined spaced relationship relative to the bottom surface 81. In particular, the imbedded fasteners 90 include a first form 91, as seen in FIGS. 9 and 9A, and a second form 92, as seen in FIGS. 10 and 10A. With respect to the first form of the invention as seen in FIGS. 9 and 9A, the first form 91 has an imbedded support member which is generally indicated by the numeral 93, and which is rotatably molded into the sidewall 74, and positioned between the inside facing surface 75 and the outside facing surface 76 thereof. The imbedded support member has an elongated main body 94 which has a substantially centrally disposed aperture 95 formed therein. A fastener 96 of substantially conventional design is received within the aperture 95 and forcibly engages same. The fastener has a threaded shaft 97 which extends outwardly, and normally relative to the outside facing surface 76 as seen in FIG. 9. Similarly, the second form 92 (FIG. 10) of the imbedded fasteners 90 includes an imbedded support member which is generally indicated by the numeral 100 as seen in FIG. 10. The imbedded support member is defined by a main body 101 which has a plurality of radiating tabs 102 extending outwardly therefrom. Similarly, a centrally disposed aperture 103 is formed therein, and which is operable to receive a fastener 104 of conventional design. The fastener 104 has a threaded shaft 105 which extends normally outwardly relative to the outside facing surface 76 of the main body 71. As illustrated by reference to FIGS. 9A and 10A, a plurality of apertures 106 are formed in each of the main bodies 94 and 101, respectively. These apertures permit flowable thermoplastic material which forms the main body 71 to move therethrough so as to firmly anchor the respective imbedded support members 93 and 100 in a fixed orientation relative to the sidewall 74. The respective fasteners 96 and 104, respectively, may be welded directly to the respective main bodies 94 and 101, respectively. As seen in the drawings, the respective fasteners protrude from the exterior facing surface 76 and are useful for attaching an auxiliary device such as the pair of fluid dispensing nozzles 40 on the floor cleaning tool 10. Further, as illustrated by references to FIGS. 9 and 10, the fasteners are imbedded into the vacuum chamber 70 and do not protrude from the interior or inside facing surface 75 thereof.

Figure 8:
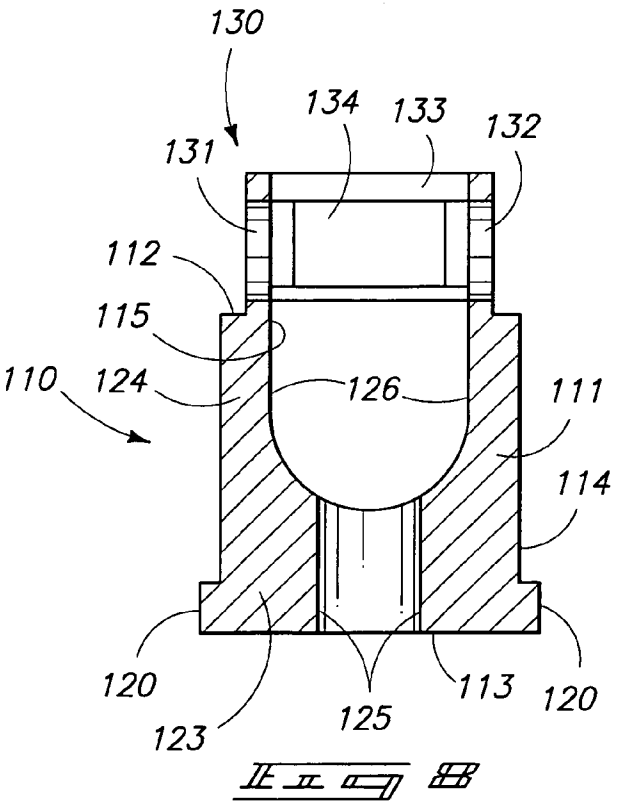
FIG. 8 is a transverse, vertical, sectional view taken through a coupling member which forms a feature of the present invention.
Figure 11:
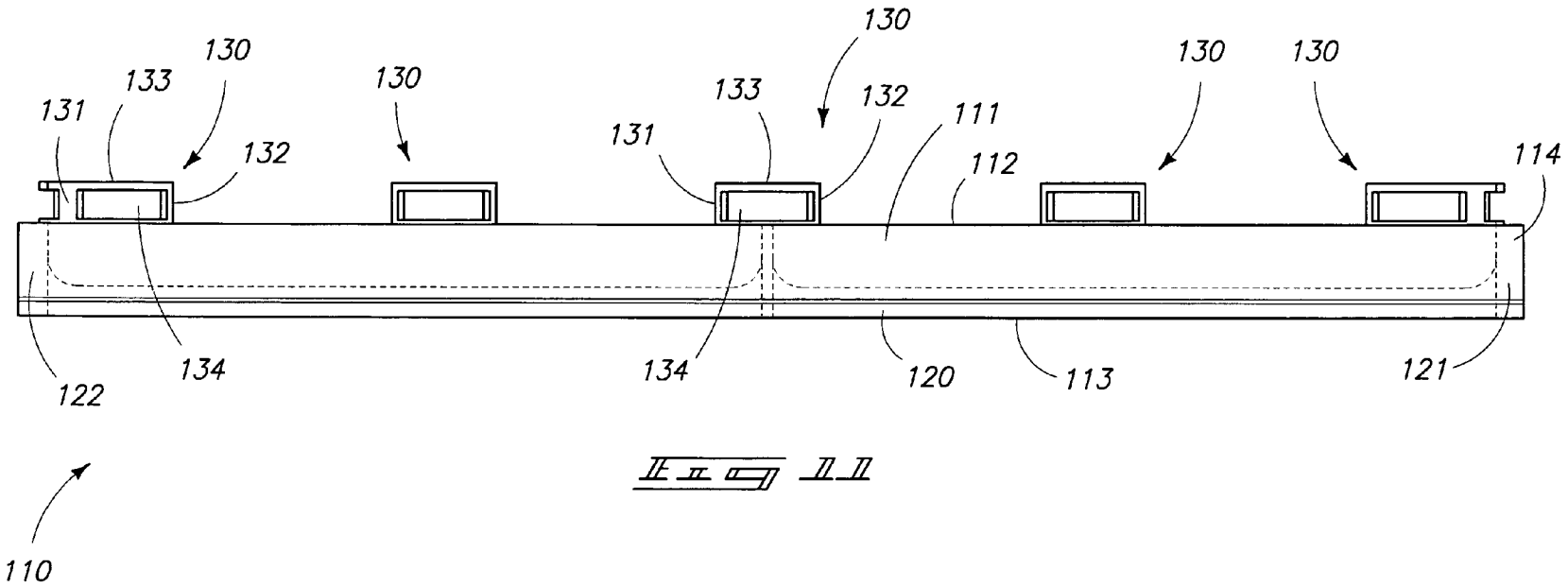
FIG. 11 is a longitudinal, side elevation view of a coupling member which forms a feature of the present invention.

Referring now to FIGS. 6, 7, 8 and 11, which shows one possible form of the invention, it will be seen that the floor cleaning tool 10 includes a coupling member 110 which is integrally affixed to the first fluid intake end 72 of the vacuum chamber 70. The coupling member 110, which is typically fabricated from a metal substrate, has a main body 111 which has a top surface 112 and an opposite bottom surface 113 which is typically substantially planar (FIG. 8). The main body 111 has a length dimension. Still further, the main body 111 has an exterior facing surface 114, and an opposite interior facing surface 115. As seen most clearly by reference to FIG. 8, the exterior facing surface 114 defines a pair of tenons 120 which extend normally outwardly relative to the exterior facing surface 114 and which are substantially coplanar with the bottom surface 113 thereof. The pair of tenons 120 extend along the entire length thereof as seen in FIG. 11. The pair of tenons are operable to cooperate with a mortise as will be described hereinafter to gain several beneficial effects over the prior art of record. In the arrangement as seen in the drawings noted above, however, the main body 111 has opposite first and second ends 121 and 122, respectively. The main body is formed into a narrow rectangular shape. Still further, and referring now to FIG. 8, the main body has a first portion 123, and an integral, second portion 124. As illustrated in FIG. 8, the first portion 123 defines a first fluid passageway 125 with a given width dimension, and the second portion 124 of the coupling member defines a second fluid passageway 126 which is coupled in fluid flowing relation relative to the first fluid passageway 125. As seen in the drawing, the second fluid passageway 126 has a width dimension greater than the width dimension of the first fluid passageway 125. Still further as will be recognized from a study of FIG. 7, the rotationally molded thermoplastic material which forms the vacuum chamber 70 is deposited, at least in part, within the second fluid passageway 125 to a width dimension which is substantially equal to the width dimension of the first fluid passageway 126. This rotationally molded thermoplastic material which forms a portion of the vacuum chamber 70 defines a male member 84. Therefore, as will be seen in FIG. 7, the elongated aperture 82 which is formed in the first fluid intake end 72 of the vacuum chamber 70 is coupled in fluid flowing relation relative to the coupling member 110.

Referring now to FIGS. 8 and 11, it will be seen that the second portion 124 of the coupling member 110, and more specifically, the top surface 112 thereof is made integral, at least in part, with the fluid intake end 72 of the vacuum chamber 70. As seen in FIGS. 8 and 11, the coupling member 110 includes a plurality of anchor members 130 which are made integral with the top surface 112, and which extend substantially normally upwardly therefrom. The plurality of anchors are positioned laterally inwardly relative to the exterior outside facing surface 114. The plurality of anchors 130 each include first and second opposite end walls 131 and 132, respectively, and a top surface 133 which is coupled, at its opposite ends, to the first and second end walls 131 and 132. Still further, the first and second end walls, and the top surface 131, 132 and 133 define an internal cavity 134 which is operable to receive a thermoplastic material which forms, at least in part, the main body of the vacuum chamber 70. More specifically, and as seen in FIG. 7, and when rotatably molded as a single piece, the thermoplastic material forming the sidewall 74 is received in and through the anchor members thereby firmly affixing the main body 71 to the coupling member 110. Still further, it will be seen that the outside facing surface 76 of the vacuum chamber 70 is substantially coplanar with the exterior or outside facing surface 114 of the coupling member in the region of the first fluid intake end 72 of the vacuum chamber 70.

Figure 3:
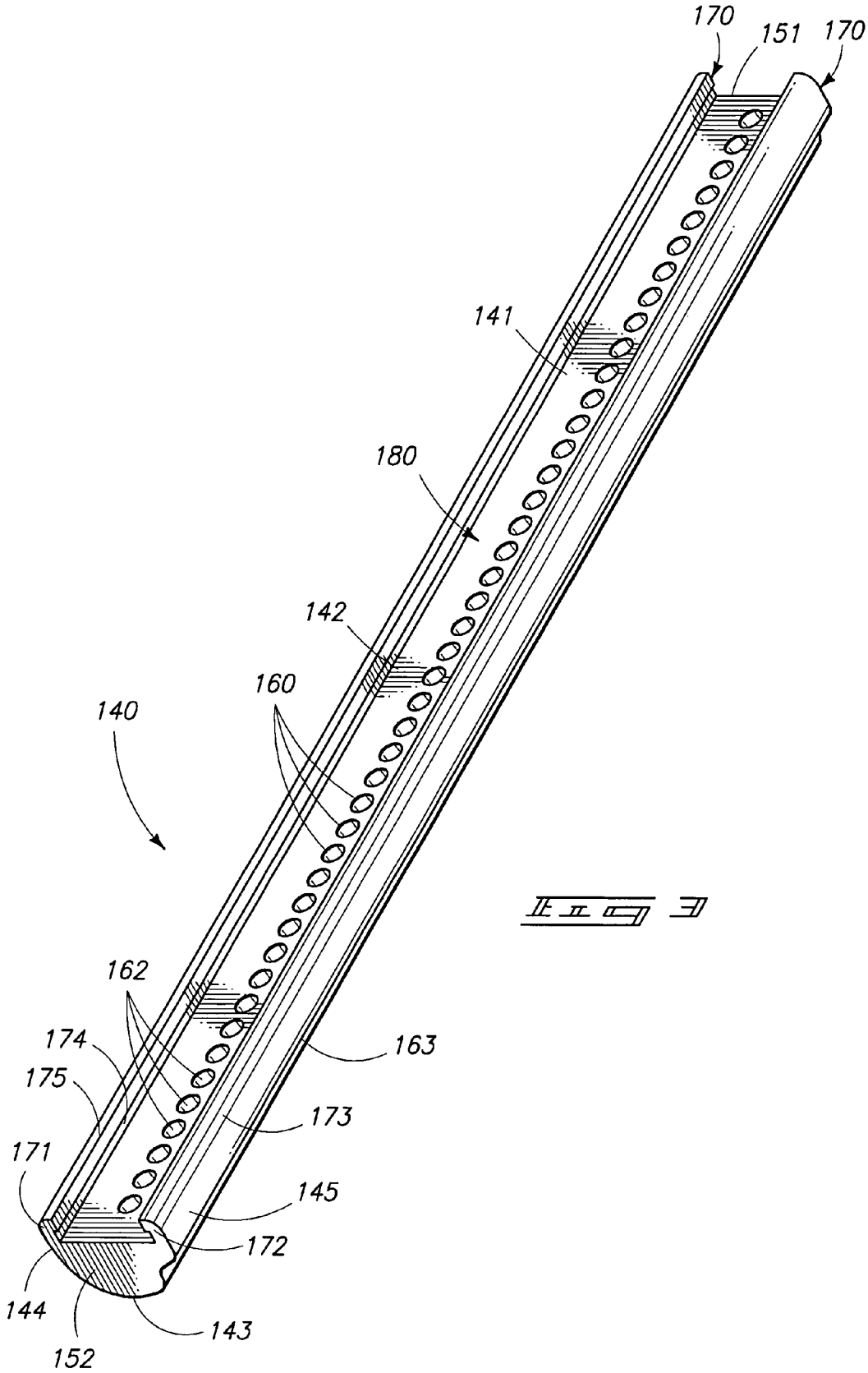
FIG. 3 is a top plan view of a floor engagement member which forms a feature of the present invention.
Figure 4:
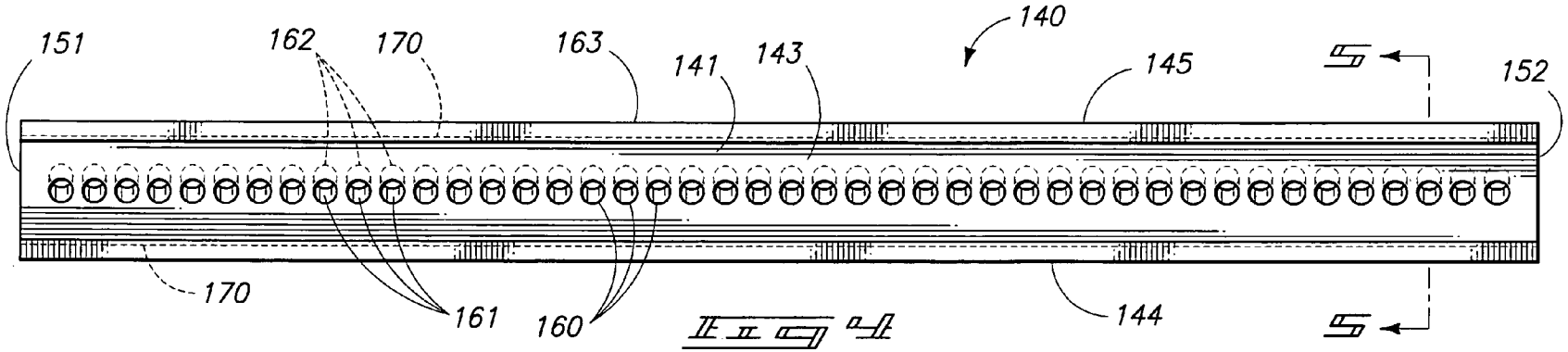
FIG. 4 is a second, top plan view of a floor engagement member which forms a feature of the present invention.
Figure 12:
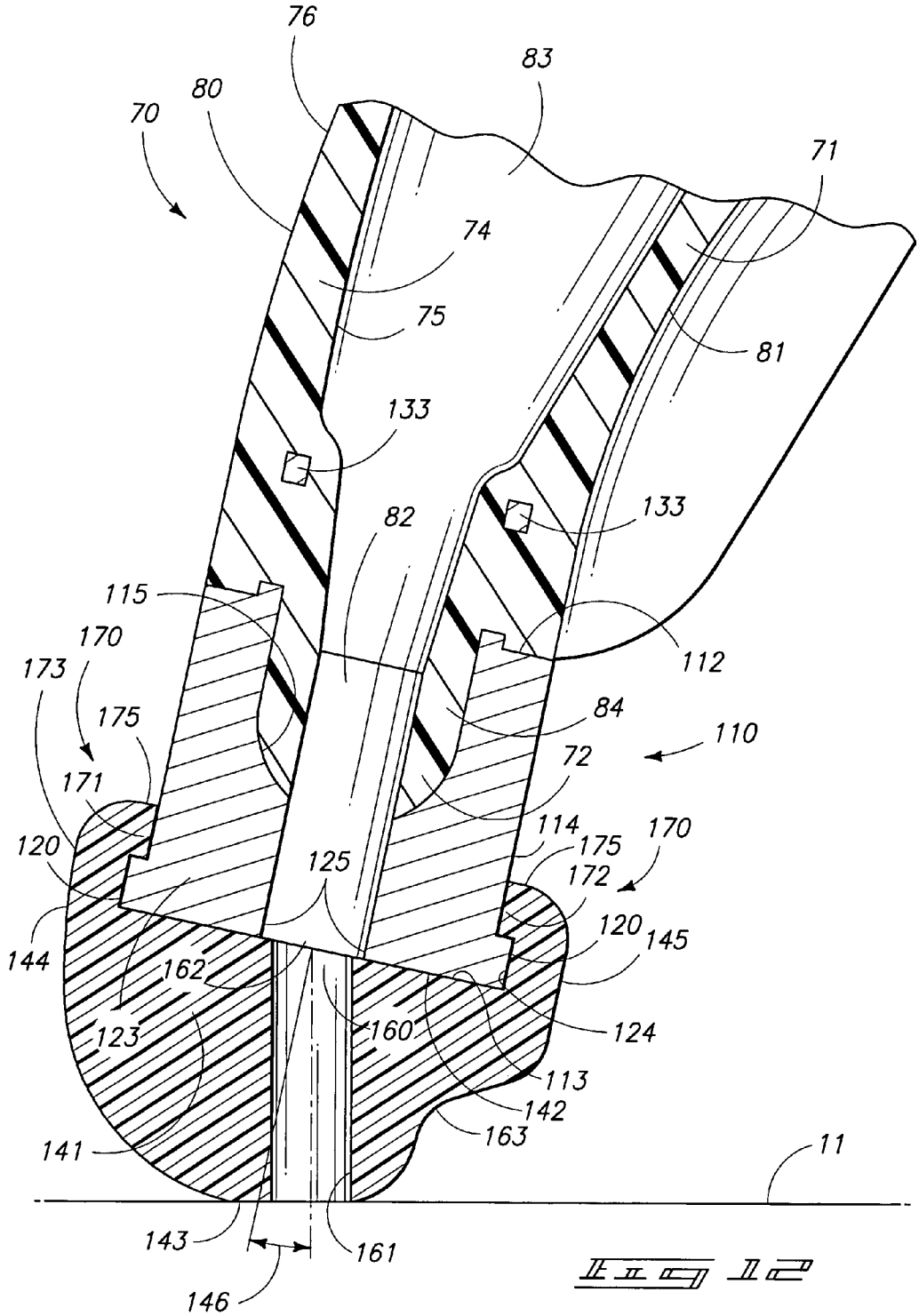
FIG. 12 is a fragmentary vertical sectional view taken from a position along line 12-12 of FIG. 1.
Figure 11:
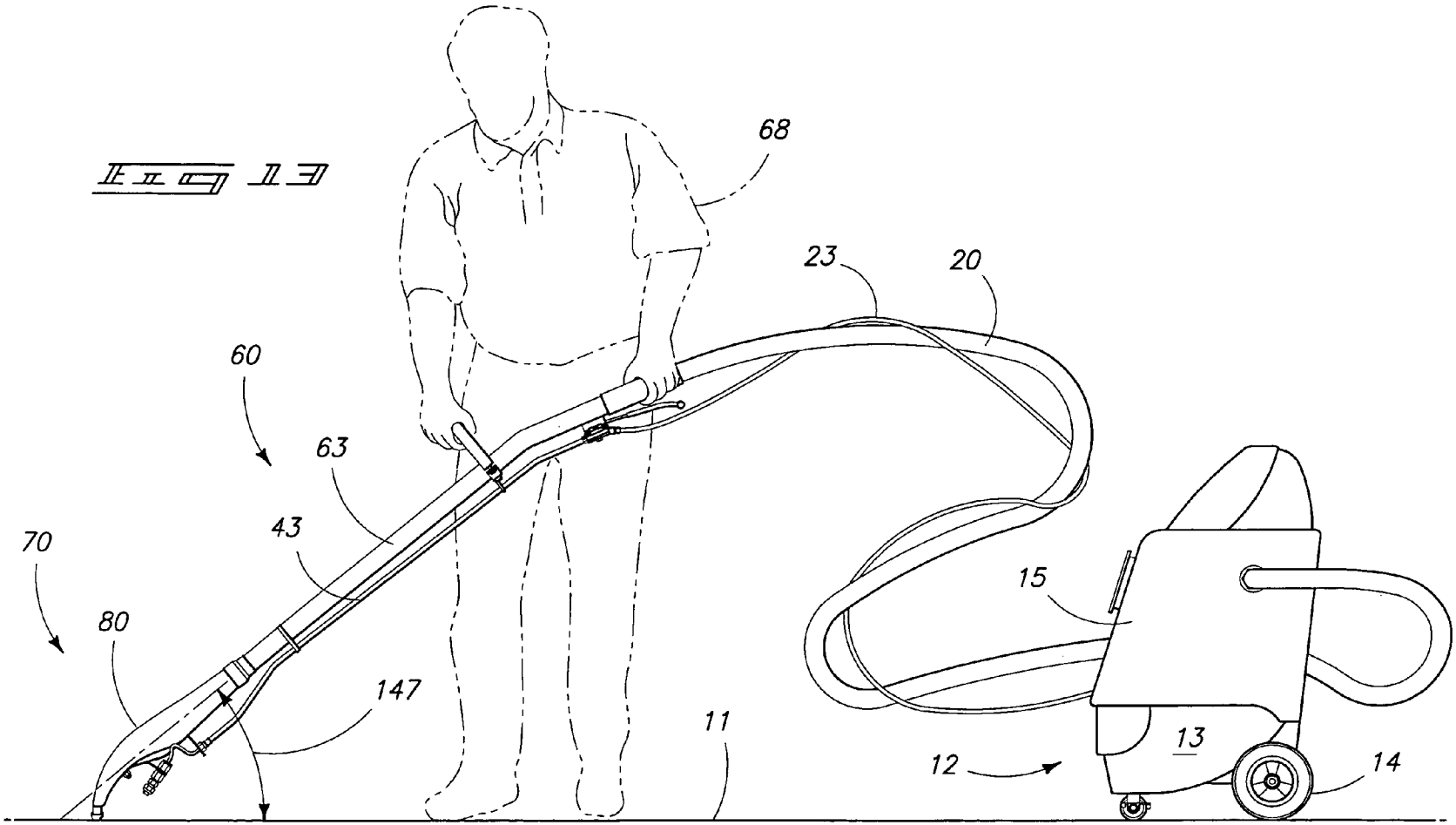

The floor cleaning tool 10 of the present invention includes a floor engagement member 140 and which is releasably secured to the coupling member 110 by means of a mortise and tenon joint which will be discussed in greater detail below. In another possible form of the invention, the floor engaging member could be made integral with the vacuum chamber 70. In still another possible form of the invention 10, the floor engagement member 140 could be releasably affixed to the vacuum chamber 70 by assorted conventional fasteners (not shown). In the form of the invention as seen in the drawings, the floor engagement member 140 has a main body 141 which has a top surface 142, and a bottom surface 143, and a length dimension. Still further, the main body has a leading edge 144, and a trailing edge 145. Still further, the main body has a first end 151 and an opposite second end 152. As illustrated most clearly by reference to FIGS. 3-5, the main body defines a plurality of inlet ports 160 which are disposed in a given non-perpendicular orientation of about 12° (146, FIG. 12) relative to the top surface 142 of the floor engagement member. As seen in the drawings, the plurality of substantially equally spaced inlet ports 160 each have a substantially equal diametral dimension and cross-sectional area and which further extend through the floor engagement member 140, and are disposed in fluid flowing relation relative to the first fluid passageway 25 which is defined by the coupling member 110. The floor engagement member 140, as seen in the drawings, has a complexly curved bottom surface 143 which moves across a floor 11 to be cleaned. Each of the plurality of inlet ports is defined by a longitudinal axis and the floor engagement member 140 locates the floor cleaning tool 10 in an ergonomically acceptable orientation of about 45° 147 for an operator 68 thereof when the respective longitudinal axes of the respective inlet ports are oriented substantially perpendicular relative to a floor 11 (FIGS. 12 and 13). Still further, the sum totals of the cross-sectional areas of the individual inlet ports 160 lies in the range of greater than about 70%. In one form of the invention, the cross sectional areas lie in a preferred range of about 70% to less than about 85% of the cross-sectional area of the vacuum conduit 60 which is coupled in fluid flowing relation relative to the vacuum chamber 70. While not being bound by any theories, it is believed that the complexly curved, bottom surface 143; angle of orientation 146 of the inlet ports 160; and cumulative cross sectional areas of all that inlet ports 160, in combination, provide superior performance relative to other prior art devices which are employed for identical purposes. Additionally, the complexly curved surface does not penetrate a carpeted floor 11 thereby reducing the undesirable effects associated with the prior art devices utilized heretofore. As best seen by reference to FIGS. 3 and 5, a cavity 163 is defined therebetween the bottom surface 143 and the trailing edge 145 of the main body 141. Still further, and extending normally, upwardly from the top surface 142 is a pair of sidewalls which are generally indicated by the numeral 170. The pair of sidewalls are defined by a first sidewall 171 and a second sidewall 172. Each of the respective sidewalls 171 and 172 has an outside facing surface 173, and an opposite, inside facing surface 174. Still further, each of the sidewalls 170 have a top surface 175 which extends normally inwardly relative to the respective sidewalls 171 and 172. As seen in the drawing, the respective inlet ports 160 terminate at the top surface 142 of the main body 141, and about an equal distance from each of the sidewalls 171 and 172. Each of the sidewalls 171 and 172, and the top surfaces thereof 175 define a mortise 180 which is dimensioned so as to matingly receive the pair of tenons 120 which extend normally outwardly relative to the exterior facing surface 114 of the coupling member 110. The mortise 180 extends along the entire length of the floor engagement member 140 as seen in FIG. 3. In the arrangement as seen most clearly by reference to FIG. 6, it will be appreciated that the floor engagement member 140 by means of the tenon and mortise 120/180 joint as described above can be slideably coupled to the coupling member 110 in an advantageous fashion, and can thereafter be removed for cleaning or replacement if the floor engagement member 180 becomes worn or damaged without substantial disassembly of present invention.

Operation

The operation of the described embodiment of the present invention is believed to be readily apparent and is briefly summarized at this point.

Figure 5:
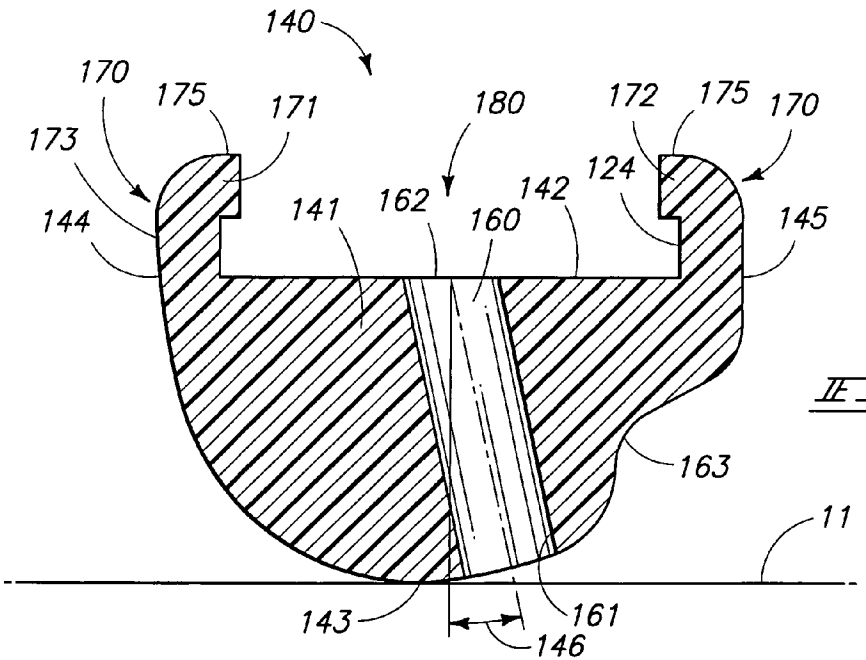
FIG. 5 is a transverse, vertical, sectional view of a floor engagement member forming a feature of the present invention and which is taken along the line labeled 5-5 of FIG. 4.
Figure 5:
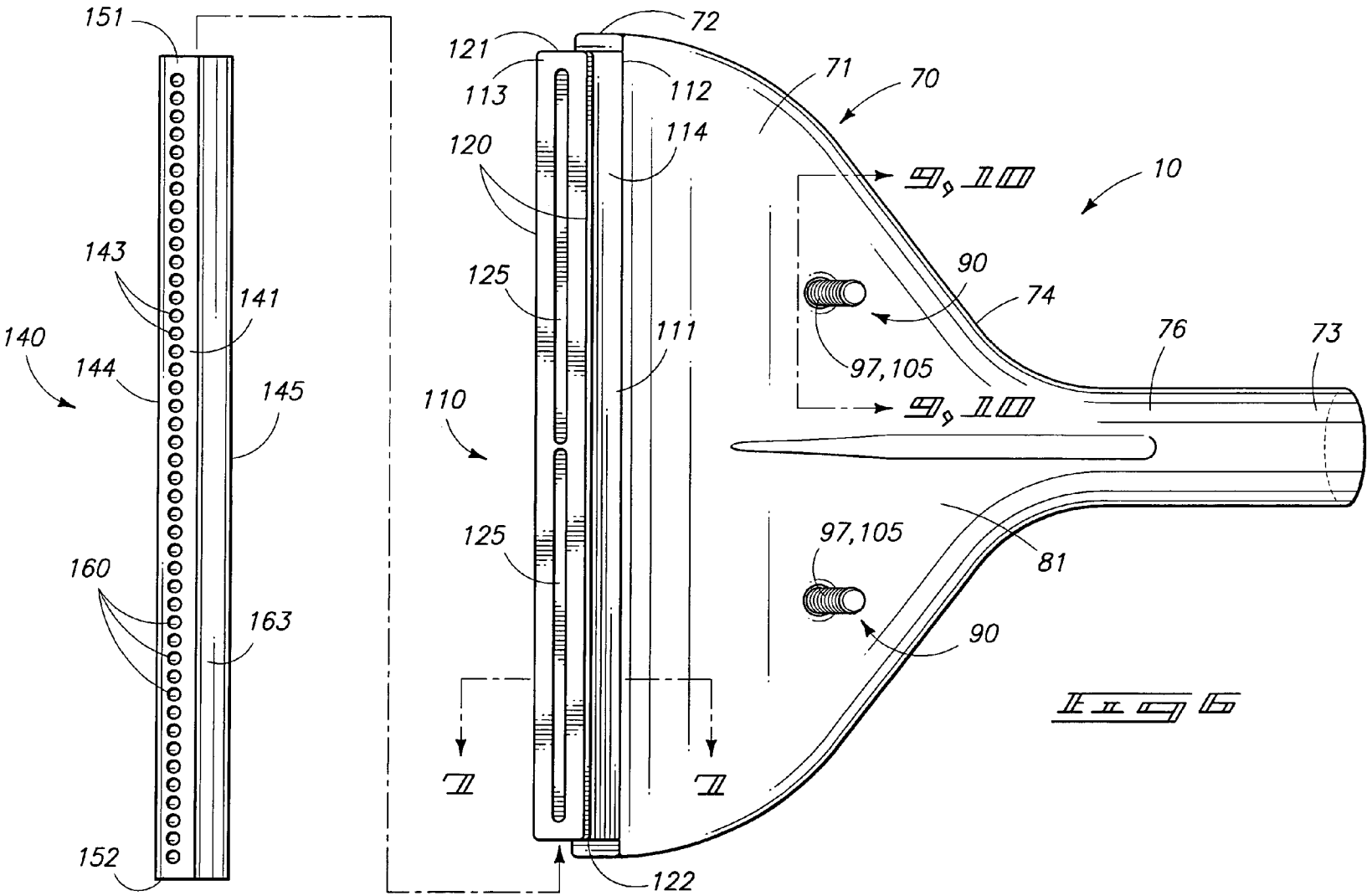

In its broadest aspect, a floor cleaning tool 10 has been described above and which includes a vacuum chamber 70 having a fluid intake end 72; and a fluid exhaust end 73; and a coupling member 110 defining a fluid passageway 125 extends therethrough, and which is integrally coupled to the fluid intake end 72 of the vacuum chamber 70. Still further, the invention includes a floor engagement member 140 having a plurality of inlet ports 160, and which is releasably secured to the coupling member 110 by means of a mortise 180 and tenon 120 joint. In the arrangement as seen in the drawings, the floor cleaning tool 10 is fabricated so it may be employed as a fluid extraction wand for use in a wet vacuum system which is generally indicated by the numeral 12. In the arrangement as seen in the drawings, the coupling member 110 defines at least one tenon 120 which extends laterally outwardly relative thereto, and wherein the floor engagement member 140 defines at least one mortise 180 for matingly receiving the at least one tenon of the coupling member 110. Alternatively, it should be recognized that the coupling member 110 may define at least one mortise for matingly receiving at least one tenon which may be provided by a floor engagement member (not shown). In the arrangement as seen in the drawings, the fluid exhaust end 73 of the vacuum chamber 70 has an inside cross sectional area dimension. In the arrangement as seen, the sum total of the cross sectional area dimensions of the plurality of inlet ports 160 is about 70% to less than 85% of the inside cross sectional area dimension of the fluid exhaust end 73. As seen in the drawings, the floor cleaning tool 10, and more specifically the vacuum chamber 70 thereof, has a width dimension which diminishes when measured in the direction extending from the first fluid intake end 72 to the fluid exhaust end 73. The arrangement as seen provides a convenient means whereby the vacuum chamber 70 is configured to provide a substantially laminar flow from the fluid intake end 72 to the fluid exhaust end 73. This laminar flow creates efficiency in the present device and permits the wet vacuum system 12 to employ smaller electrical motors while simultaneously achieving greater benefits than is possible by the current prior art devices which must use relatively large vacuum motors in order to provide sufficient suction power to clean a floor 11. The plurality of inlet ports 160 are oriented in a non-perpendicular orientation relative to the top surface 142 of the floor engagement member 140. These inlet ports locate the floor cleaning tool 10 in an ergonomically acceptable orientation for an operator thereof (not shown) when the respective longitudinal axes of the respective inlet ports are oriented substantially perpendicular relative to a floor. This is best illustrated by reference to FIG. 5. In the arrangement as seen in FIG. 5, the floor engagement member 140 has a complexly curved bottom surface 143 which moves across a floor 11 to be cleaned. As earlier discussed, the vacuum chamber 70 is rotationally molded from a thermoplastic material as a single piece. As earlier discussed, the coupling member 110 includes a first portion 123 which is spaced from the vacuum chamber 70, and a second portion 124 which is made integral, at least in part, with the fluid intake end 72 of the vacuum chamber 70. A plurality of anchoring members 130 are made integral with the second portion 124, and which further extend in the direction of the vacuum chamber 70. The respective anchoring members 130 are embedded within the molded thermoplastic material as seen in the drawings. In the arrangement as seen earlier, first portion 123 of the coupling member 110 defines a first fluid passageway 125 with a given width dimension, and the second portion 124 of the coupling member 110 defines a second fluid passageway 126 which is coupled in fluid flowing relation relative to the first fluid passageway 125. The second fluid passageway 126 has a width dimension greater than the width dimension of the first passageway 125. Still further, the rotationally molded thermoplastic material which forms the vacuum chamber 70 is deposited, at least in part, within the second passageway 126 so as to partially occlude the second passageway 126 to a width dimension which is substantially equal to the width dimension of the first passageway 125. In the arrangement as seen, the respective anchoring members 130 each define a cavity 134 which receives the rotationally molded thermoplastic material which forms the vacuum chamber 70.

More specifically, the present invention relates to a floor cleaning tool 10 for use with a vacuum cleaner 12, and which includes a vacuum conduit 60 having an inside cross sectional dimension, and wherein the vacuum conduit 60 is coupled in fluid flowing relation relative to a vacuum cleaner 12. The invention further includes a vacuum chamber 70 having a fluid intake end 72, and a fluid exhaust end 73 which is made integral with the vacuum conduit 60. Additionally, the invention 10 includes a coupling member 110 and which defines a fluid passageway 125 therethrough. The coupling member 110 is integrally affixed to the fluid intake end 72 of the vacuum chamber 70. Still further, the invention 10 includes a floor engagement member 140 which releasably slideably cooperates with the coupling member 110, and which defines a plurality of inlet ports 160 each having a cross sectional area dimension, and wherein the sum total of the cross sectional area dimensions of the plurality of inlet ports is about 70% to less than 85% of the cross sectional dimension of the vacuum conduit 60. In the arrangement as shown in the drawings, the floor engagement member 140 releasably slideably cooperates with the coupling member 110 by means of a mortise 180 and tenon 170 joint. Still further, it should be understood, the floor engagement member 140 further comprises a main body 141 having a top surface 142, and a bottom surface 143 which is defined, in part, by a leading edge 144 and a trailing edge 145. The respective inlet ports 160 are defined by the main body 141 and are substantially equally spaced along the length of the main body 141 and extend between the top 142 and bottom surfaces 143 thereof. A pair of sidewalls 170 are made integral with a top surface 142 of the main body 141 and further extend normally upwardly relative thereto. The pair of sidewalls 170 are substantially coplanar with the leading 144 and trailing 145 edges of the main body 141. Defined therebetween the pair of sidewalls 170 is a mortise 180 which is dimensioned to matingly receive the pair of tenons 120. In the arrangement as seen in the drawings, the leading edge 144 of the main body 141 of the floor engagement member 140 is complexly curved, and the plurality of inlet ports 160 are located in a non-perpendicular orientation relative to the top surface 142 thereof. The main body 141 of the floor engagement member 140 has opposite first 151 and second ends 152. A cavity 163 is formed in the main body 141, and extends between the first 151 and second ends 152 thereof, and is located between the bottom surface 143, and the trailing edge of the main body 141. In the arrangement earlier discussed, the respective inlet ports 160 terminate at the top surface 142 of the main body 141 and are located about equidistantly from each of the sidewalls 170 which defines, at least in part, the mortise 180. The plurality of inlet ports 160 are substantially equally spaced along the main body 141 from the first to the second ends 151 and 152 thereof.

Therefore, it will be seen that the floor cleaning tool 10 of the present invention, provides many advantages over previous prior art floor cleaning tools which have been introduced and utilized heretofore. The present device 10 provides a convenient means for cleaning a floor 11 in a manner not possible heretofore, and further provides a enhanced cleaning power by providing a substantial laminar flow by utilizing vacuum engines of lower relative horse power while providing superior cleaning ability.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A floor cleaning tool, comprising:

a vacuum chamber having a fluid intake end, and a fluid exhaust end, and wherein the vacuum chamber is rotationally molded from a thermoplastic material as a single piece;

a coupling member having a length dimension, and further defining a fluid passageway therethrough, and which is integrally coupled to the fluid intake end of the vacuum chamber, and wherein the coupling member further defines a pair of tenons which extend along the entire length dimension of the coupling member, and wherein the coupling member further includes a first portion which is spaced from the vacuum chamber, and a second portion which is made integral, at least in part, with the fluid intake end of the vacuum chamber, and a plurality of anchoring members are made integral with the second portion, and which further extend in the direction of the vacuum chamber, and wherein the respective anchoring members are embedded within the molded thermoplastic material; and a floor engagement member having a length dimension, and which further defines a plurality of inlet ports, and also defines a mortise which extends along the entire length dimension of the floor engagement member, and wherein the floor engagement member is releasably secured to the coupling member by the mortise and tenon.

2. A floor cleaning tool as claimed in claim 1, and wherein the floor cleaning tool is a fluid extraction wand for use in a wet vacuum system.

3. A floor cleaning tool as claimed in claim 1, and wherein the fluid exhaust end of the vacuum chamber has an inside cross sectional area dimension; and wherein the plurality of inlet ports each has a cross sectional area dimension; and wherein the sum total of the cross sectional area dimensions of the plurality of inlet ports is about 70% to less than 85% of the inside cross sectional area dimension of the fluid exhaust end.

4. A floor cleaning tool as claimed in claim 1, and wherein the vacuum chamber has a width dimension which diminishes when measured in the direction extending from the fluid intake end to the fluid exhaust end.

5. A floor cleaning tool as claimed in claim 1, and wherein the vacuum chamber is configured to provide a substantially laminar fluid flow from the fluid intake end to the fluid exhaust end.

6. A floor cleaning tool as claimed in claim 1, and wherein each of the plurality of inlet ports is defined by a longitudinal axis, and wherein the floor engagement member locates the floor cleaning tool in an ergonomically acceptable orientation for an operator thereof when the respective longitudinal axes of the respective inlet ports are oriented substantially perpendicular relative to a floor.

7. A floor cleaning tool as claimed in claim 1, and wherein the floor engagement member has a complexly curved bottom surface which moves across a floor to be cleaned.

8. A floor cleaning tool as claimed in claim 1, and wherein the first portion of the coupling member defines a first fluid passageway with a given width dimension, and wherein the second portion of the coupling member defines a second fluid passageway which is coupled in fluid flowing relation relative to the first fluid passageway, and wherein the second fluid passageway has a width dimension greater than the width dimension of the first passageway; and wherein the rotationally molded thermoplastic material which forms the vacuum chamber is deposited, at least in part, within the second passageway so as to partially occlude the second passageway to a width dimension which is substantially equal to the width dimension of the first passageway.

9. A floor cleaning tool as claimed in claim 1, and wherein the anchoring members each define a cavity which receives, at least in part, the rotationally molded thermoplastic material which forms the vacuum chamber.

10. A floor cleaning tool as claimed in claim 1, and wherein the vacuum chamber further has an interior facing surface, and an exterior facing surface, and wherein a fastener protrudes from the exterior facing surface for releasably attaching an ancillary device to the vacuum chamber; and wherein the fastener is embedded into the vacuum chamber and does not protrude from the interior facing surface of the vacuum chamber.

11. A floor cleaning tool as claimed in claim 10, wherein the fastener is a threaded bolt which has an enlarged head that anchors the bolt to the vacuum chamber.

12. A floor cleaning tool as claimed in claim 10, and wherein the ancillary device includes a fluid disbursement nozzle.

13. A floor cleaning tool as claimed in claim 10, and wherein the ancillary device includes a fluid conduit.

14. A floor cleaning tool, comprising:

a vacuum chamber having a fluid intake end, and a fluid exhaust end, and which is rotationally molded from a thermoplastic material as a single piece;

a coupling member defining a fluid passageway extending therethrough, and which is integrally coupled to the fluid intake end of the vacuum chamber, and wherein the coupling member has an elongated main body defined by opposite sidewalls, opposite first and second ends, a bottom surface, and a top surface, and wherein the main body of the coupling member has a pair of tenons which extend normally outwardly and in coplanar relation relative to each other and along the entire length of the coupling member, and wherein the fluid intake end of the vacuum chamber is located, at least in part, with the fluid passageway, and wherein the fluid passageway defined by the elongated main body extends between the top and bottom surfaces, and wherein the fluid passageway further has a first portion which extends from the bottom surface in the direction of the top surface, and which further has a first cross sectional dimension, and a second portion which is coupled in fluid flowing relation relative to the first portion, and which extends from the first portion to the top surface of the main body, and wherein the second portion has a cross sectional dimension greater than the cross sectional dimension of the first portion;

a plurality of anchors made integral with the top surface of the coupling member, and wherein the fluid intake end of the vacuum chamber is located within the second portion of the fluid passageway; and a floor engagement member having a plurality of inlet ports, and which defines a mortise for matingly engaging the pair of tenons, and wherein the floor engagement member is releasably coupled to the coupling member by means of a mortise and tenon joint.

15. A floor cleaning tool as claimed in claim 14, and wherein the respective anchors extend normally upwardly relative to the top surface, and are recessed laterally inwardly relative to the opposite sidewalls.

16. A floor cleaning tool as claimed in claim 14, and wherein the respective anchors each define a cavity which extends therethrough.

17. A floor cleaning tool as claimed in claim 14, and wherein the plurality of anchors are made integral with the sidewall of the vacuum chamber and are located in the region which is adjacent to the fluid intake end thereof, and wherein the respective anchors are located between the interior and exterior facing surfaces thereof.

18. A floor cleaning tool as claimed in claim 14, and wherein the fluid passageway as defined by the coupling member includes two elongated passageways which are substantially longitudinally coaxially aligned.

19. A floor cleaning tool as claimed in claim 14, and wherein the floor engagement member further comprises:

a main body having a top surface, and a bottom surface, which is defined, in part, by a leading edge and a trailing edge, and wherein the inlet ports are defined by the main body and are substantially equally spaced along the length of the main body, and extend between the top and bottom surfaces thereof; and a pair of sidewalls made integral with the top surface of the main body, and further extending normally upwardly relative thereto, and wherein the pair of sidewalls are substantially coplanar with the leading and trailing edges of the main body and define therebetween a mortise which is dimensioned to matingly receive the pair of tenons.

20. A floor cleaning tool as claimed in claim 19, and wherein the leading edge of the main body of the floor engagement member is complexly curved, and wherein the plurality of inlet ports are located in a non-perpendicular orientation relative to the top surface of the main body.

21. A floor cleaning tool as claimed in claim 20, and wherein the main body of the floor engagement member has opposite first and second ends, and wherein a cavity is formed in the main body, and which extends between the first and second ends, and is located therebetween the bottom surface and the trailing edge of the main body.

22. A floor cleaning tool as claimed in claim 21, and wherein the respective inlet ports terminate at the top surface of the main body and are located about equidistantly from each of the sidewalls which defines the mortise, and wherein the plurality of inlet ports are substantially equally spaced along the main body from the first to the second ends thereof.

23. A floor cleaning tool, comprising:

a vacuum chamber having an interior and exterior facing surface, and a fluid intake end, and a fluid exhaust end, and wherein the fluid intake end defines a male member;

a coupling member which is integrally coupled to the fluid intake end of the vacuum chamber, and which further has an elongated main body having a length dimension and which is further defined by opposite sidewalls, opposite first and second ends, a bottom surface, a top surface, and which further has a fluid passageway defined by the main body, and extends between the top and bottom surfaces, and wherein the fluid passageway further has a first portion which extends from the bottom surface in the direction of the top surface, and a second portion which is coupled in fluid flowing relation relative to the first portion, and which extends from the first portion to the top surface of the main body, and wherein the second portion has a cross sectional dimension greater than the cross sectional dimension of the first portion, and wherein the male member of the vacuum chamber is received in the second portion of the fluid passageway; and wherein the coupling member further has a plurality of anchors made integral with the top surface thereof, and which extend normally upwardly relative to the top surface, and which each define a cavity which extends therethrough, and which are recessed laterally inwardly relative to the opposite sidewalls thereof, and which are made integral with the fluid intake end so as to secure the coupling member to the vacuum chamber; and wherein the main body of the coupling member further has a pair of tenons which individually extend normally outwardly, and in a coplanar relation relative to the bottom surface of the main body, and along the entire length of the main body; and a floor engagement member having a plurality of inlet ports, and which is releasably secured to the coupling member by means of a mortise and tenon joint, and which has a main body having a top surface, and a bottom surface, which is defined, in part, by a leading edge and a trailing edge; and wherein the inlet ports are defined by the main body and are substantially equally spaced along the length of the main body, and extend between the top and bottom surfaces thereof, and wherein the floor engagement member further has a pair of sidewalls made integral with the top surface of the main body, and further extending normally upwardly relative thereto, and wherein the pair of sidewalls are substantially coplanar with the leading and trailing edges of the main body and define therebetween a mortise which is dimensioned to matingly receive the pair of tenons; and wherein the leading edge of the main body of the floor engagement member is complexly curved, and wherein the plurality of inlet ports are located in a non-perpendicular orientation relative to the top surface of the main body, and wherein the inlet ports terminate at the top surface of the main body and are located about equidistantly from each of the sidewalls which defines the mortise, and wherein the plurality of inlet ports are substantially equally spaced along the main body from the first to the second ends thereof; and wherein the vacuum chamber is defined by a sidewall having opposite interior and exterior facing surfaces, and wherein the fluid intake end of the vacuum chamber is matingly received, at least in part, within the second portion of the fluid passageway as defined by the coupling member, and wherein the plurality of anchors are made integral with the sidewall of the vacuum chamber and in the region which is adjacent to the fluid intake end thereof, and wherein the respective anchors are located between the interior and exterior facing surfaces thereof, and wherein the exterior facing surface of the sidewall of the vacuum chamber is substantially coplanar with the opposite sidewalls of the coupling member.

24. A floor cleaning tool as claimed in claim 23, and wherein the vacuum chamber is rotationally molded from a thermoplastic material as a single piece.

* * * * *